US007614722B2

(12) United States Patent
Izawa et al.

(10) Patent No.: US 7,614,722 B2
(45) Date of Patent: Nov. 10, 2009

(54) INKJET RECORDING APPARATUS

(75) Inventors: Hideo Izawa, Narashino (JP); Junichi Setoyama, Narashino (JP); Yuuichi Yamazaki, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 414 days.

(21) Appl. No.: 11/590,951

(22) Filed: Nov. 1, 2006

(65) Prior Publication Data

US 2007/0109348 A1 May 17, 2007

(30) Foreign Application Priority Data

Nov. 16, 2005 (JP) ..... 2005-331007

(51) Int. Cl.
*B41J 2/165* (2006.01)

(52) U.S. Cl. ..... 347/34

(58) Field of Classification Search ..... 347/30, 347/34, 84, 85, 101, 104
See application file for complete search history.

(56) References Cited

U.S. PATENT DOCUMENTS 6,464,328 B1 10/2002 Hiramatsu et al.

FOREIGN PATENT DOCUMENTS

JP 62-111749 5/1987
JP 02-179761 7/1990
JP 2000-108357 4/2000
JP 2004-306270 11/2004
JP 2005-212323 8/2005

*Primary Examiner*—An H Do
(74) *Attorney, Agent, or Firm*—Cohen Pontani Lieberman & Pavane LLP

(57) ABSTRACT

An inkjet recording apparatus having a plurality of inkjet heads arranged along a paper conveyance line is disclosed, which is capable of collecting an ink mist efficiently without making the inkjet heads intricate in makeup. To this end, an air suction and blast unit is disposed in a space between the upstream and downstream inkjet heads which are successive and includes a housing, an air suction port provided at one side of the housing, an air blast nozzle provided at the other side of the housing, a fan provided between the air suction port and the air blast nozzle in the housing for creating an air flow flowing from the air suction port to the air blast nozzle and a mist filter in the housing for catching an ink mist in the air flow created by the fan, wherein the air suction port is opposed from a downstream side to a gap between an under surface of the upstream inkjet head and the paper conveyance line while the air blast nozzle is opposed from an upstream side to a gap between the downstream inkjet head and the paper conveyance line.

8 Claims, 4 Drawing Sheets

INKJET RECORDING APPARATUS

BACKGROUND OF THE INVENTION

1. Technical Field

The present invention relates to an inkjet recording apparatus in which a plurality of inkjet heads are arranged in a direction in which recording paper is to travel and, more particularly, to such an inkjet recording apparatus which is capable of collecting and removing an ink mist that occurs between an under surface of each inkjet head and the recording paper.

2. Description of the Prior Art

In an inkjet recording apparatus, while recording is effected by the adhesion of ink particles discharged from a nozzle head to recording paper, during recording with such ink, ink particles may occur which are not adhered to the recording paper (recording medium). And, they become an ink mist, and the problem arises that the ink mist floating between the nozzle head and recording paper comes to contaminate not only the surface of recording paper but also the nozzle head.

For this reason, each nozzle head in an inkjet recording apparatus in the prior art is provided with an opening or port opposite to recording paper and a suction unit which communicates with the opening to suck an ink mist floating between the nozzle head and recording paper from the opening and thereby to remove the ink mist. See, for example, JP H02-179761 A.

Also, in another inkjet recording apparatus in the prior art, downstream of a nozzle head having a plurality of ink nozzles arranged therein, an air suction port and an air blast port are provided opposite to each other and with recording paper whereby an ink mist occurring between the nozzle head and the recording paper is sucked through the air suction port at a downstream side of the nozzle head and hot air is discharged from the air blast port to dry a recorded image on the recording paper. See, for example, JP S62-111,749 A.

Since the nozzle head is provided with the suction port in the former of the prior art and the suction and blast ports in the latter of the prior art, an air piping which connects to such a port or ports must be provided in the nozzle head and the problem arises that the internal mechanism within the nozzle head which is of a limited space becomes intricate.

Moreover, in both the arrangements of the prior art, the air suction port for sucking an ink mist is open facing the recording paper to suck air in a space between the nozzle head and the recording paper in a direction perpendicular to the recording paper and at the same time to cause air from the environment to flow from around the nozzle head into the space between the nozzle head and the recording paper. As a result, the air flow by such an air suction port becomes turbulent so that it becomes impossible to smoothly such air in a gap between the nozzle head and the recording paper and to efficiently remove and suck an ink mist there.

SUMMARY OF THE INVENTION

With these problems taken into account, it is an object of the present invention to provide an inkjet recording apparatus which in removing and collecting an ink mist between a nozzle head and recording paper, makes it unnecessary to provide an air piping in each nozzle head and thus simplifies the internal mechanism of each inkjet head containing the nozzle head while permitting such an ink mist to be efficiently removed and collected.

In order to achieve the object mentioned above there is provided in accordance with the present invention an inkjet recording apparatus in which a plurality of inkjet heads are arranged along a paper conveyance line, characterized in that:

it comprises: an air suction and blast unit disposed in a space between the upstream and downstream inkjet heads which are successive, the unit including a housing, an air suction port provided at one side of the housing, an air blast nozzle provided at the other side of the housing, a fan provided between the air suction port and the air blast nozzle in the housing for creating an air flow flowing from the air suction port to the air blast nozzle and a mist filter in the housing for catching an ink mist in the air flow created by the fan, wherein:

the air suction port is opposed from a downstream side to a gap between an under surface of the upstream inkjet head and the paper conveyance line while the air blast nozzle is opposed from an upstream side to a gap between the downstream inkjet head and the paper conveyance line.

According to the makeup mentioned above, by the arrangement that a means for removing and collecting an ink mist that occurs below an under surface of an inkjet head is provided in the form of a single body so that no air piping is connected thereto, it becomes unnecessary to provide the air piping in an inkjet head as in the prior art wherein a means for removing and collecting an ink mist is provided in the inkjet head, and it becomes possible to simplify the internal structure of an inkjet head itself. Also, it becomes possible to structurally simplify the means for removing and collecting an ink mist and to set up the same readily.

Further, since a laminar air flow is generated in a gap between an under surface of each inkjet head and the paper conveyance line over a length of path from its respective upstream to downstream sides, an ink mist that has occurred in the gap can efficiently be removed to the downstream side of each inkjet head together with the air flow mentioned above. And, by passing the total amount of the air flow having the ink mist entrained therein through the ink filter, it is made possible to efficiently collect the ink mist.

In the makeup mentioned above, it is preferable that the discharge rate of air from the air blast nozzle in the air suction and blast unit be adjustable.

This specific makeup allows the air flow rate to be adjusted according to the discharge rate of the ink from the inkjet head, thereby permitting the ink mist to be collected without disturbing the ink discharge.

In the makeup mentioned above, it is preferable that there be further included: an air blast unit disposed upstream of an upstream-most inkjet head and including an air discharging blast nozzle opposed from an upstream side to a gap between an under surface of the upstream-most inkjet head and the paper conveyance line; and an air suction unit disposed downstream of a downstream-most inkjet head and including an air sucking suction port opposed from a downstream side to a gap between an under surface of the downstream-most inkjet head and the paper conveyance line.

According to this specific makeup, it becomes possible to blow air in a laminar flow from the upstream side into below the upstream-most of a series of the inkjet heads as well while sucking from the downstream side air below the downstream-most inkjet head as well and hence to efficiently remove and collect ink mists over all the inkjet heads.

DESCRIPTION OF THE PREFERRED EMBODIMENTS

Figure 1:
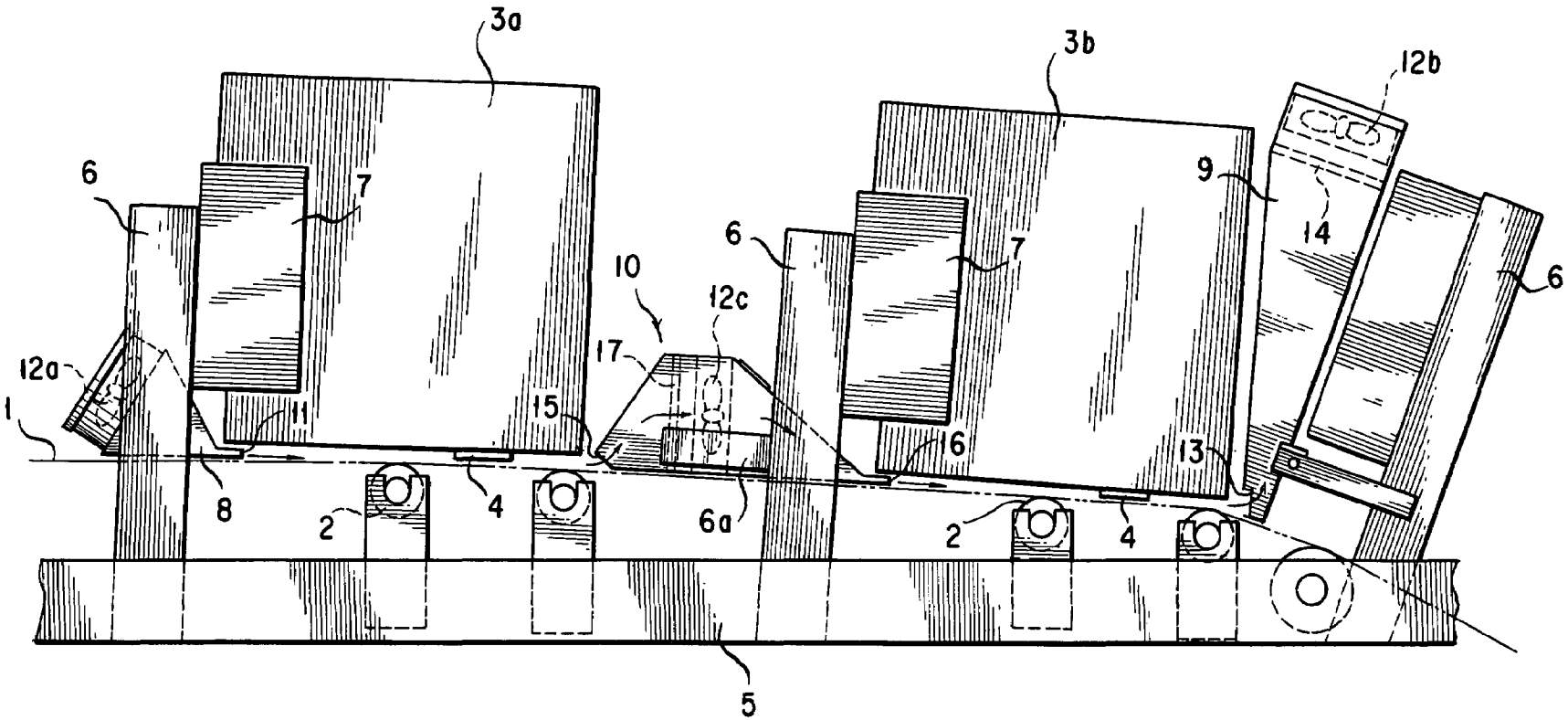
FIG. 1 is a side view diagrammatically illustrating one embodiment of an inkjet recording apparatus according to the present invention.
Figure 2:
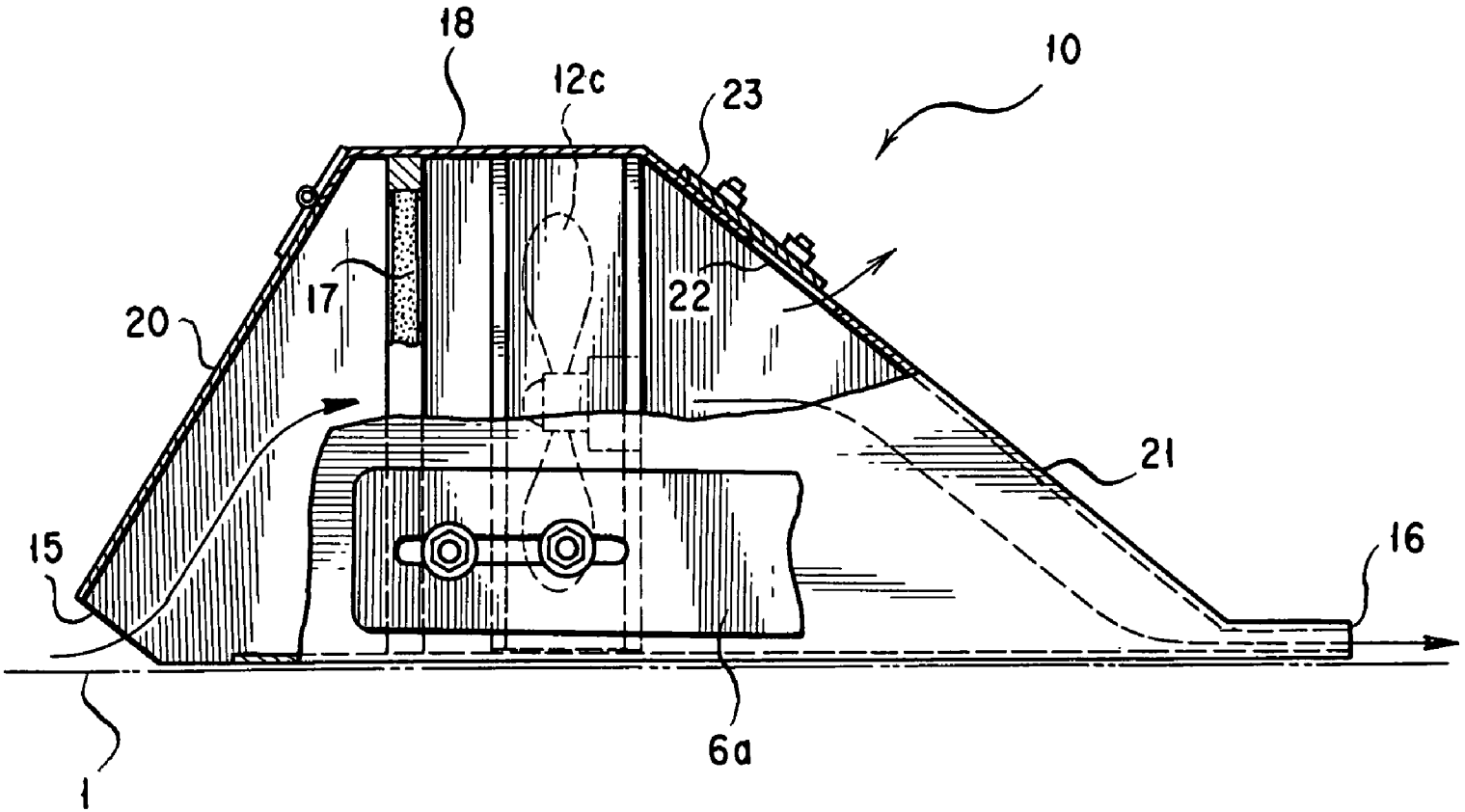
FIG. 2 is a side view, in part cut away, illustrating an air suction and blast unit in the embodiment shown in FIG. 1.
Figure 3:
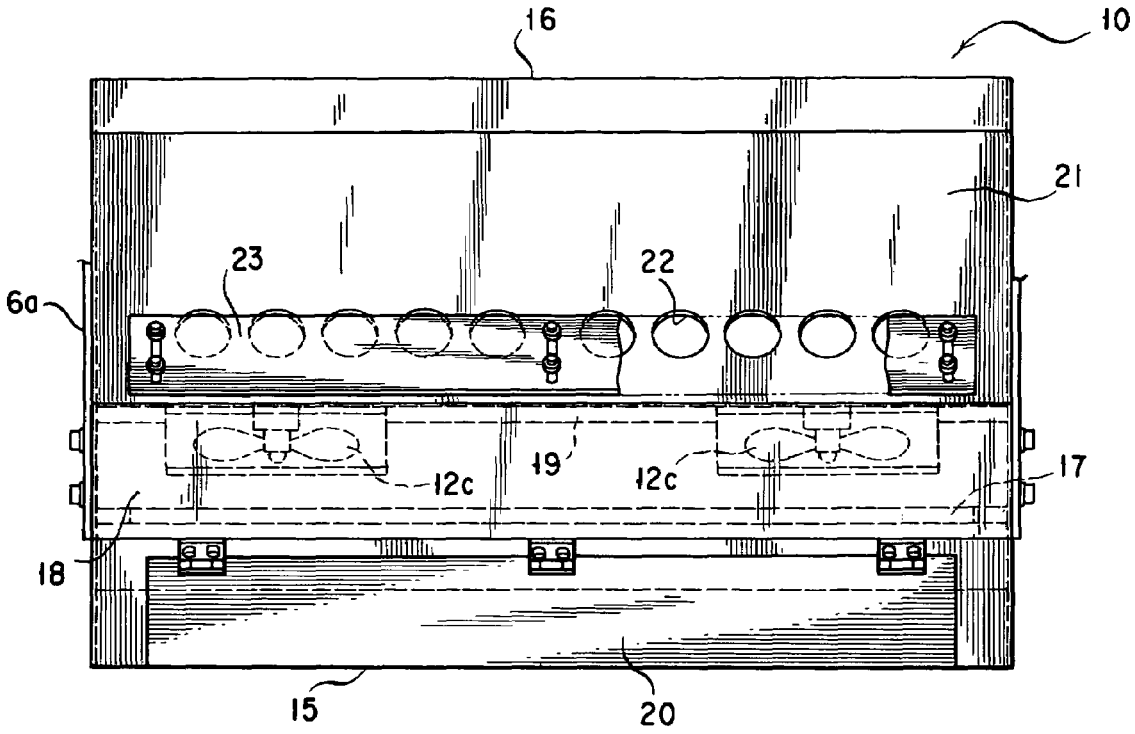
FIG. 3 is a plan view, in part cut away, illustrating the air suction and blast unit shown in FIG. 2.
Figure 4:
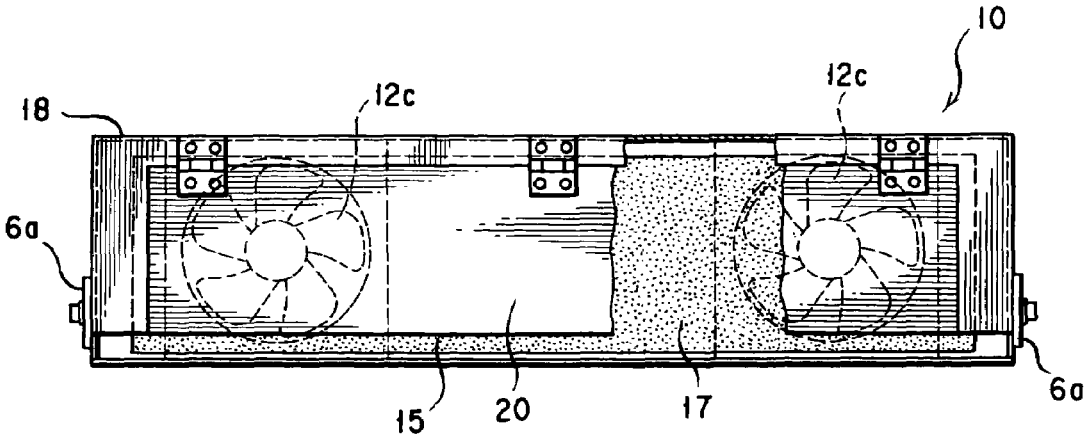
FIG. 4 is a front view, in part cut away, illustrating the air suction and blast unit shown in FIG. 2.
Figure 5:
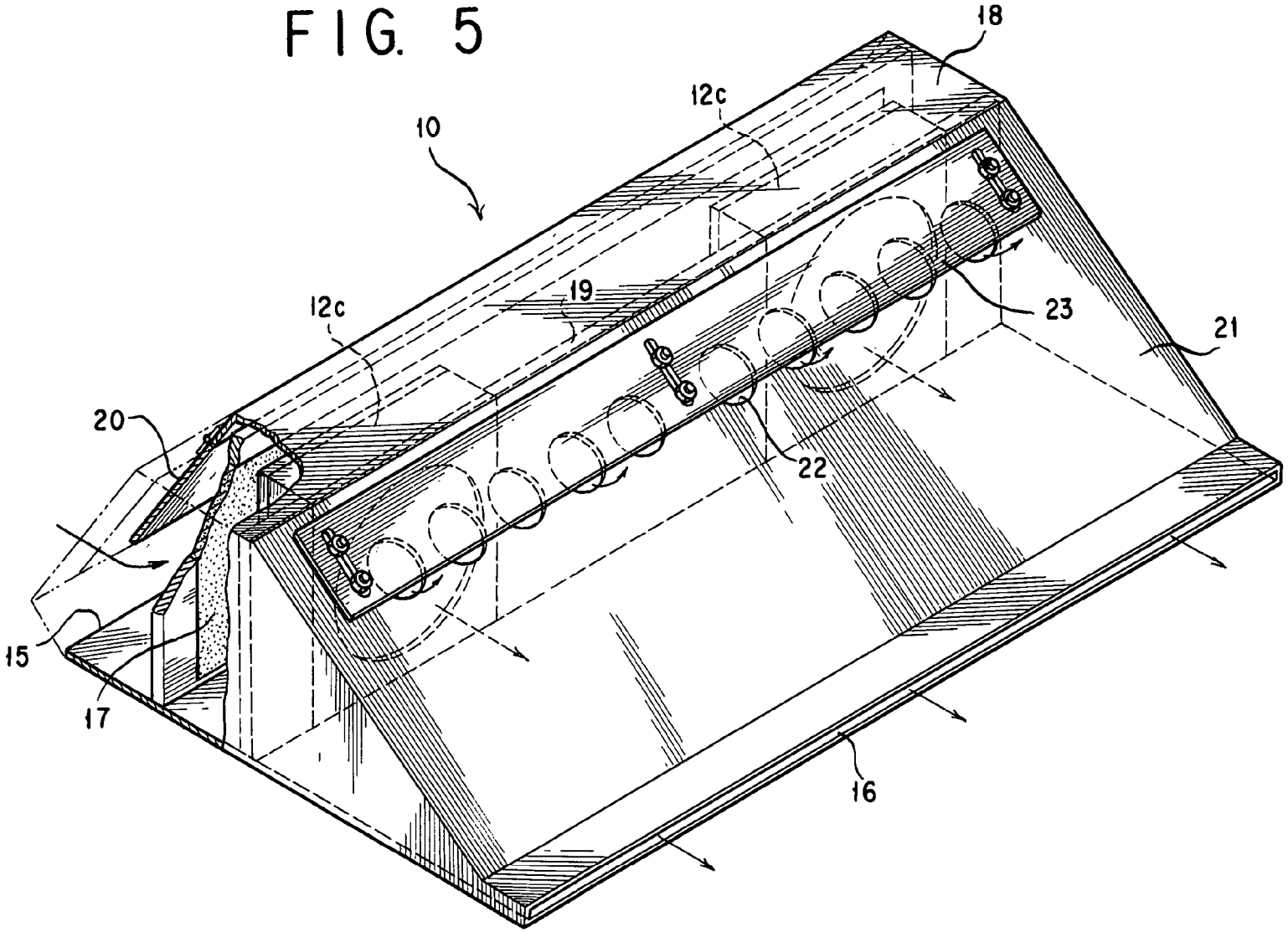
FIG. 5 is a perspective view, in part cut away, illustrating the air suction and blast unit shown in FIG. 2.

An explanation is given of forms of implementation of the present invention with reference to the Drawing Figures. In FIG. 1, the apparatus includes guide rollers 2, 2, . . . , constituting a paper conveyance line along which recording paper (i. e., roll paper or sheet paper) is to travel, a plurality of, here two, inkjet heads, 3*a* and 3*b*, mounted along this paper conveyance line, and nozzle heads 4, 4 each of which is mounted at an under surface of the inkjet head 3*a*, 3*b*. Each of these nozzle heads 4 and 4 has a structure that ink nozzles are arranged therein in a line in a direction of the width of recording paper 1.

Each of the inkjet heads 3*a* and 3*b* is supported via a supporting unit 7 from a bracket 6 fastened to a frame 5. The supporting unit 7 is equipped with known adjustment mechanisms including a height adjusting mechanism for adjusting the spacing (height) of the nozzle head 4 of the inkjet head 3*a*, 3*b* from the recording paper 1 traveling on the aforementioned paper conveyance line, a posture adjusting mechanism for adjusting the angular position of the nozzle head 4 relative to the surface of the recording paper, and a horizontal movement mechanism for moving the inkjet head 3*a*, 3*b* as a whole in a transverse direction of the frame 5 (in a direction perpendicular to the drawing sheet).

Upstream of the upstream-most 3*a* of the inkjet heads 3*a*, 3*b*there is mounted an air blast unit 8 for blowing air from the upstream side into a gap between the under surface of the inkjet head 3*a* and the recording paper 1, and downstream of the downstream-most inkjet head 3*b* there is mounted an air suction unit 9 for sucking air in a gap between the inkjet head 3*b* and the recording paper 1 from the downstream side. And, in an area between successive inkjet heads 3*a* and 3*b* there is mounted an air suction and blast unit 10 for sucking air in a gap between the upstream-more inkjet head 3*a* and the recording paper 1 from the downstream side and blowing the sucked air from the upstream side of the downstream-more inkjet head 3*b* into a space between the downstream-more inkjet head 3*b* and the recording paper 1.

The air blast unit 8 is provided with an air blast nozzle 11 having its width extending over a full width of the inkjet head 3*a* and an axial flow fan 12*a* for feeding air towards the air blast nozzle 11. And, this air blast unit 8 is supported by the bracket 6 so that its air blast nozzle 11 is directed towards the gap between the inkjet head 3*a* and the recording paper 1 from its upstream side.

The air suction unit 9 is provided with an air suction port 13 having its width extending over a full width of the inkjet head 3*b*, an axial flow fan 12*b* for sucking air from the air suction port 13 and an ink filter 14 positioned upstream of the fan 12*b*. And, this air suction unit 9 is supported by the bracket 6 so that its air suction port 13 is directed towards the gap between the inkjet head 3*b* and the recording paper 1 from its downstream side.

The air suction and blast unit 10 is provided with an air suction port 15 and an air blast nozzle 16 positioned upstream and downstream, respectively, in the direction in which the recording paper travels. The air suction port 15 and the air blast nozzle 16 have their widths extending over full widths of the inkjet heads 3*a* and 3*b*, respectively. The air suction and blast unit 10 is also provided with an axial flow fan 12*c* for sucking air through the air suction port 15 and blowing air through the air blast nozzle 16, and with an ink filter 17 positioned upstream of the axial flow fan 12*c*. And, this air suction and blast unit 10 is supported by the bracket 6 so that its air suction port 15 is directed towards the gap between the upstream inkjet head 3*a* and the recording paper 1 from its downstream side and that its air blast nozzle 16 is directed towards the gap between the downstream inkjet head 3*b* and the recording paper 1 from its upstream side. To wit, this air suction and blast unit 10 positioned between the inkjet heads 3*a* and 3*b* is configured so that its air suction port 15 is opposed to the gap between the downstream end of the upstream inkjet head 3*a* and that the end of its air blast nozzle 16 enters a little the under side of the downstream inkjet head 3*b* from its upstream side.

FIGS. 2 to 5 shows an embodiment of the air suction and blast unit 10 in which two axial flow fans 12*c* are provided received in a housing 18 and mounted to a partition plate 19 that partitions the housing 18 into an upstream and a downstream portion of a direction in which air flows in a direction of width of the housing 18. And, in the housing 18, the ink filter 17 is mounted at the upstream side of the partition plate 19 and extends over the entire width of the housing 18. An upside wall 20 of a duct defining the air suction port 15 can be turned up so that it may be opened (by being turned up) at the time of maintenance and inspection of the fans 12*c* and 12*c* and the ink filter 17. Also, an upside wall 21 defining the air blast nozzle 16 is formed with a plurality of opening holes 22 in a direction of width of the housing 18 and has in a regions of these opening holes 22 a damper plate 23 which can be moved in a direction in which to vary the outside opening areas of the holes 22.

In the makeup mentioned above, recording is effected on paper 1 with ink discharged from the nozzle head 4 of each inkjet head 3*a*, 3*b* while the recording paper 1 is traveling along the paper conveyance line. And then, the fans 12*a*, 12*b* and 13*c* in the air blast unit 8, the air suction unit 9 and the air suction and blast unit 10, respectively, are driven.

Thus, air discharged out of the air blast nozzle 11 of the air blast unit .8 flows past the gap between an under surface of the upstream-most inkjet head 3*a* and the recording paper 1 in a laminar flow towards the downstream side of travel of the recording paper 1. Then, downstream of the inkjet head 3*a*, it is sucked through the air suction port 15 of the air suction and blast unit 10.

Meanwhile, air sucked through the air suction port 15 of the air suction and blast unit 10 and past the ink filter 17 is blown off through the air blast nozzle 16, which then flows past the gap between the under surface of the downstream inkjet head 3*b* and the recording paper 1 in a laminar flow in the direction of travel of the recording paper 1 and is sucked through the air suction port 13 of the air suction unit 9 at a downstream side of the inkjet head 3*b*.

An ink mist that has occurred around the ink head 4 of the upstream inkjet head 3*a* is then sucked with the air suction and blast unit 10 and caught by its ink filter 17. Also, an ink mist that has occurred around the ink head 4 of the downstream inkjet head 3*b* is sucked with the air suction unit 9 and caught by its ink filter 14.

The airflows at the air blast unit 8, the air suction unit 9 and the air suction and blast unit 10 can be adjusted with their respective fans 12*a*, 12*b* and 12*c* of variable type, by varying the rates of rotation of these fans, respectively. And, especially in the air suction and blast unit 10, the airflow from the air blast nozzle 16 is adjusted by shifting the position of the damper plate 23 to change the outside opening areas of the holes 22 and letting portions of the winds from the fans 12*c* and 12*c* flow to the outside. This adjustment of each air flow is made according to the discharge quantity of ink from the nozzle head 4 of each inkjet head 3*a*, 3*b*.

Although only two inkjet heads 3*a* and 3*b* are shown with the air suction and blast unit 10 mounted between them in the illustrated form of implementation, there may be three or more inkjet heads 3*a*, 3*b*, . . . with an air suction and blast unit 10 mounted between successive inkjet heads.

Although in the illustrated form of implementation the air blast unit 8 upstream of the upstream-most inkjet head 3*a* and the air suction unit 9 downstream of the downstream-most inkjet head 3*b* are shown, they may not necessarily be used if the air suction and blast unit 10 is provided between successive inkjet heads.

In this case, an ink mist that occurs in the gap between the upstream-most inkjet head 3*a* and the recording paper 1 is sucked with a sucking airflow by the suction port 15 of a suction and blast nozzle 10 provided downstream thereof. Also, an ink mist that occurs in the gap between the downstream-most inkjet head 3*b* and the recording paper 1 is blown off towards its downstream side with air discharged from the air blast nozzle 16 of an air suction and blast unit 10 provided upstream thereof.

The fan in each unit used for air blast and suction is of axial flow type optimally in consideration of its space, but may possibly be of centrifugal or sirocco type. The number of such fans used in each unit may be varied depending on the size of each unit in its width direction, etc.

What is claimed is:

1. An inkjet recording apparatus in which a plurality of line-type inkjet heads are arranged along a paper conveyance direction, the inkjet recording apparatus comprising:

an air suction and blast unit disposed in a space between upstream and downstream inkjet heads which are successive in the paper conveyance direction, the air suction and blast unit including:

a housing, an air suction port provided at one side of the housing, an air blast nozzle provided at another side of the housing, a fan provided between the air suction port and the air blast nozzle in the housing for creating an air flow flowing from the air suction port to the air blast nozzle, and a mist filter in the housing for capturing ink mist in the air flow created by the fan, wherein the air suction port is opposed from a downstream side to a gap between an under surface of the upstream inkjet head and the paper conveyance line; and wherein the air blast nozzle is opposed from an upstream side to a gap between the downstream inkjet head and the paper conveyance line.

2. The inkjet recording apparatus as set forth in claim 1, wherein a discharge rate of air from the air blast nozzle in the air suction and blast unit is adjustable.

3. The inkjet recording apparatus as set forth in claim 2 further comprising:

an air blast unit disposed upstream of an upstream-most inkjet head and including an air discharging blast nozzle opposed from an upstream side to a gap between an under surface of the upstream-most inkjet head and the paper conveyance line; and an air suction unit disposed downstream of a downstream-most inkjet head and including an air sucking suction port opposed from a downstream side to a gap between an under surface of the downstream-most inkjet head and the paper conveyance line.

4. The inkjet recording apparatus as set forth in claim 2 further comprising an air blast unit disposed upstream of an upstream-most inkjet head and including an air discharging blast nozzle opposed from an upstream side to a gap between an under surface of the upstream-most inkjet head and the paper conveyance line.

5. The inkjet recording apparatus as set forth in claim 2 further comprising an air suction unit disposed downstream of a downstream-most inkjet head and including an air sucking suction port opposed from a downstream side to a gap between an under surface of the downstream-most inkjet head and the paper conveyance line.

6. The inkjet recording apparatus as set forth in claim 1 further comprising:

an air blast unit disposed upstream of an upstream-most inkjet head and including an air discharging blast nozzle opposed from an upstream side to a gap between an under surface of the upstream-most inkjet head and the paper conveyance line; and an air suction unit disposed downstream of a downstream-most inkjet head and including an air sucking suction port opposed from a downstream side to a gap between an under surface of the downstream-most inkjet head and the paper conveyance line.

7. The inkjet recording apparatus as set forth in claim 1 further comprising an air blast unit disposed upstream of an upstream-most inkjet head and including an air discharging blast nozzle opposed from an upstream side to a gap between an under surface of the upstream-most inkjet head and the paper conveyance line.

8. The inkjet recording apparatus as set forth in claim 1 further comprising an air suction unit disposed downstream of a downstream-most inkjet head and including an air sucking suction port opposed from a downstream side to a gap between an under surface of the downstream-most inkjet head and the paper conveyance line.

* * * * *